United States Patent [19]

Cordry

[11] Patent Number: 4,669,554

[45] Date of Patent: Jun. 2, 1987

[54] GROUND WATER MONITORING DEVICE AND METHOD

[76] Inventor: Kent E. Cordry, 148 Mountaire Pkwy., Clayton, Calif. 94517

[21] Appl. No.: 809,507

[22] Filed: Dec. 16, 1985

[51] Int. Cl.[4] ..... E21B 49/08

[52] U.S. Cl. ..... 175/59; 166/264; 166/169; 73/155

[58] Field of Search ..... 166/264, 162, 165, 166, 166/168, 169, 333, 334; 175/58, 59, 20, 21, 233, 234, 314; 73/155

[56] References Cited

U.S. PATENT DOCUMENTS

| | | | |
|---|---|---|---|
| 58,479 | 10/1866 | Rhoades | 175/234 |
| 58,721 | 10/1866 | Duck et al. | 175/314 X |
| 58,769 | 10/1866 | Bruen | 175/314 |
| 166,136 | 7/1875 | Patterson | 175/314 X |
| 1,489,916 | 2/1923 | Blamphin | 175/20 |
| 1,514,585 | 1/1921 | Edwards | 166/116 |
| 1,998,075 | 8/1933 | Church | 175/235 |
| 2,085,972 | 8/1934 | Halliburton | 166/106 |
| 2,141,261 | 12/1938 | Clark | 166/264 X |
| 2,870,844 | 1/1959 | Barnes | 166/165 |
| 4,310,057 | 1/1982 | Brame | 175/21 |

FOREIGN PATENT DOCUMENTS

| | | | |
|---|---|---|---|
| 0221793 | 5/1985 | German Democratic Rep. | 166/264 |
| 1035198 | 8/1983 | U.S.S.R. | 166/264 |

OTHER PUBLICATIONS

Dutch Cone Penetrometer brochure by Hogentogler & Company Gaithersburg, Md. 20877-0385.

Article titled: "A New System for Ground Water Monitoring", by Bengt-Arne Torstensson.

Cone Penetrometer Testing brochure by The Earth Technology Corporation, Long Beach, Calif. 90807.

Article appearing in "Plant and Soil", Journal dated Apr. 1973.

Brochure by Johnson Watermark titled "Stainless Steel Drive Points", St. Paul, Minn. 55164.

*Primary Examiner*—Stephen J. Novosad
*Assistant Examiner*—David J. Bagnell
*Attorney, Agent, or Firm*—Christie, Parker & Hale

[57] ABSTRACT

A device and method are set forth to obtain a ground water sample. The device includes a drive cone adapted to penetrate the ground and a main body having a closed sample chamber. The main body is movable relative to the cone between the first position where the body and cone abut for inserting the device into the ground and a second position where the cone is frictionally restrained by the ground and the body is withdrawn upwardly relative to the cone to expose a sampling tube. The tube including a plurality of openings to receive ground water into the chamber. After receiving the sample, the device is retrieved from the ground.

17 Claims, 5 Drawing Figures

14
18
24
16
22
20
26
28
12
28
30
28
10

GROUND WATER MONITORING DEVICE AND METHOD

FIELD OF THE INVENTION

This invention relates to devices for obtaining samples of ground water.

BACKGROUND OF THE INVENTION

The concern over toxic waste entering ground water supplies has resulted in a dramatic increase in the number of ground water investigations. Heretofore, most of the investigations have required the installation of water quality monitoring wells to determine if ground water contamination exists and to define or map the vertical and horizontal extent of the contamination. The cost of installing monitoring wells is high and hence geophysical techniques have been used to minimize the number of monitoring wells. High resolution of geophysical surveys are expensive and are not always accurate in determining the locations and contaminant concentrations. As a result, more wells must be provided because of improperly placed or too few monitoring wells.

SUMMARY OF THE INVENTION

There is, therefore, provided in the practice of the present invention a device and method for inexpensibly and quickly retrieving a chemically representative ground water sample.

Toward this end, a device according to the present invention is provided and is adapted to be inserted into the ground to obtain a ground water sample. The device includes a drive cone adapted to penetrate the ground and a main body having a closed sample chamber. The main body is movable relative to the cone between a first position where the body and cone abut for inserting the device, cone first, into the ground and a second position where the cone is frictionally restrained by the ground and the body is withdrawn upwardly relative to the cone. A sampling tube is affixed to one of either the cone or body. The tube includes a plurality of openings to receive ground water. The tube communicates with the chamber for delivering the received ground water thereto. The tube is isolated from the ground when the body is in the first position and while the device is being inserted into the ground. When the desired depth has been reached and upon withdrawal of the body to the second position the tube is exposed whereupon ground water passes through the tube into the chamber. After receiving the sample, the device is pulled from the ground for retrieval thereof. Means are provided for preventing the collected sample from reversibly passing from the chamber through the exposed tube during withdrawal of the device.

As can be appreciated, the device according to the present invention, may be driven into the ground by any suitable means such as a hydraulic ram or the like and to any suitable depth by locating the device at the end of a rod or pipe string. A ground water sample can thusly be quickly and economically received and retrieved for analysis thereof. The device can be reused and multiple samplings can be economically made.

The method according to the present invention includes inserting the device into the ground, the device including a drive cone for penetrating the earth and a main body which, during the inserting step, contacts and pushes the cone, the body defining a hollow chamber to receive a ground water sample. After the device has been inserted into the ground to the desired depth, the method includes withdrawing the body an increment relative to the cone to expose a perforated tube, the ground water entering the tube and flowing into the body sample chamber. The device is then withdrawn from the ground, the method further including preventing the sample from flowing in a reverse direction from the chamber. After the device has been withdrawn, the sample in the chamber may be emptied into a sample collection container or the like for future analysis.

As can be appreciated, the method according to the present invention provides a simple, inexpensive and quick procedure to obtain a ground water sample from any desired depth. The inserting step may include driving or pushing the device at the end of the pipe string or rod to the desired depth or inserting the device into a previously drilled hole and driving or pushing the device to the desired sampling depth.

BRIEF DESCRIPTION OF THE DRAWINGS

These and other features and advantages of the present invention will become appreciated as the same becomes better understood with reference to the following specification, claims and drawings wherein:

DETAILED DESCRIPTION

Figure 1:
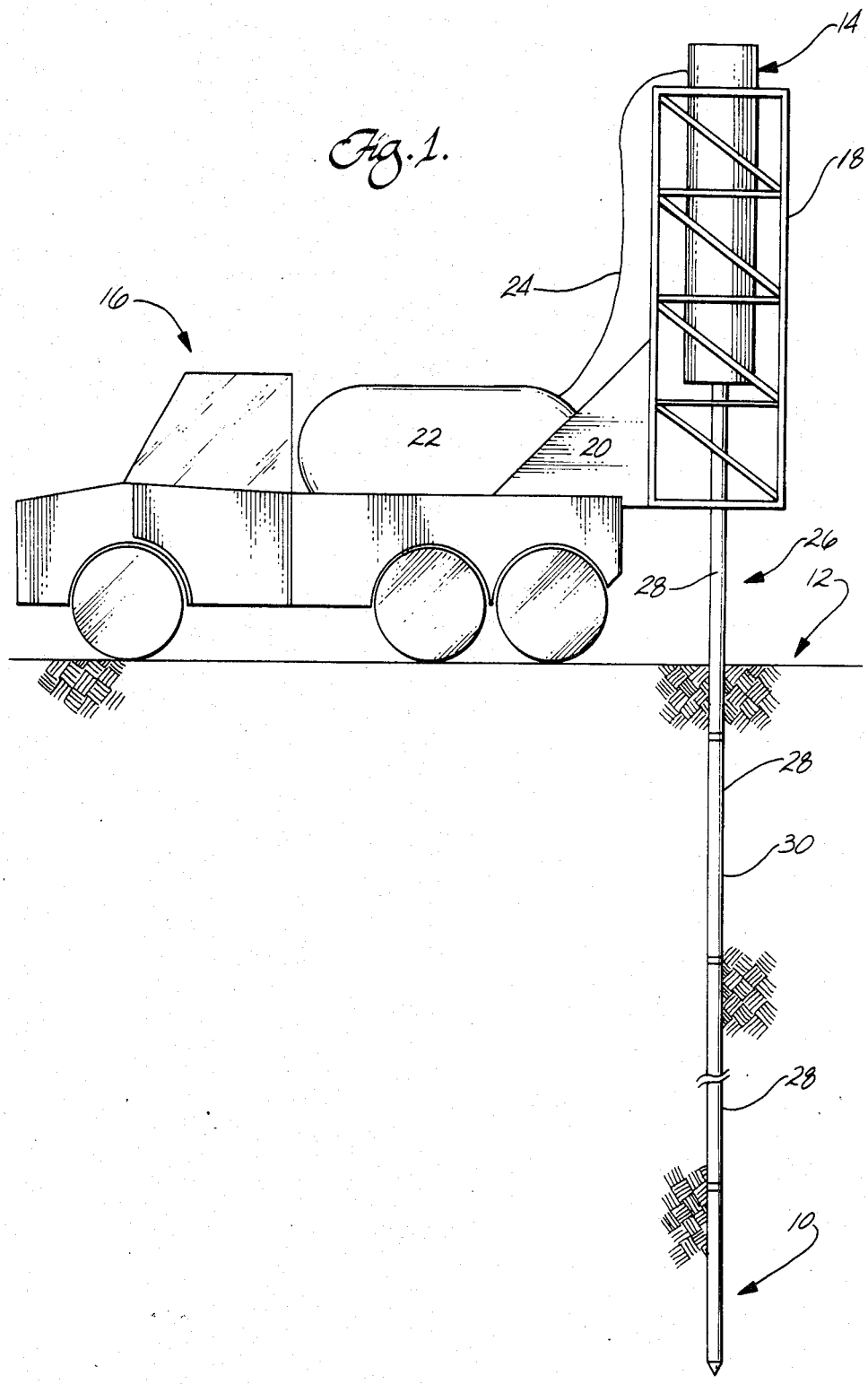
FIG. 1 is a semi-schematic side elevation view showing one embodiment of a device provided in accordance with the present invention inserted into the ground for gathering a ground water sample.

Turning the drawings, FIG. 1 shows a device 10 according to the present invention which has been inserted into the earth shown generally as 12 for collection of a chemically representative ground water sample. The collection of a ground water sample by the device 10 for analysis will enable investigators to determine whether or not the ground water has become contaminated by toxic waste or the like, an to accurately quantify contaminant levels. By collecting and analyzing samples at various locations at a particular site the extent of ground water contamination can be mapped. It is to be understood that while the device and description hereinafter set forth is particularly used for collection of ground water samples that it can have a variety of uses including the establishment of a shallow, permanent monitor well or for collection of ground water samples under lagoons and ponds as well as piezometric mapping and collection of soil gas samples.

To collect the ground water sample the device 10 is driven or inserted into the earth 12 to the desired depth. The insertion of the device 10 can be accomplished by any one of a variety of methods. One method, as shown in FIG. 1, includes a hydraulic ram 14 supported on a vehicle such as a truck 16. The ram 14 is retained within a support leg 18 which may be pivotally mounted to the truck bed for movement between a horizontal position for transportation of the leg 18 and ram 14 to the desired site to the vertical orientation as shown. A bracket 20 attaches the leg to the bed of the truck 16. Equipment 22 aboard the truck which includes pumps, valves and controls, is provided for operating and controlling the ram 14. Hydraulic and control lines as represented by line 24 lead from the equipment 22 to the ram 14 for operation thereof.

Ram 14 is adapted to drive a rod or pipe string 26 including one or more pipe segments 28 into the earth 12. The device 10 is attached to the first pipe segment 28 at the initial penetration of the earth 12, the remaining pipe segments 28 being assembled in a sequential fashion as the string 26 is inserted further into the earth 12. Similarly, when it is desired to retrieve the device, the ram 14 is operated to pull the string from the earth, the pipe segments 28 sequentially disassembled as they emerge until finally the device 10 is recovered. The insertion of the device 10 and string 26 creates a bore 30 extending from the surface to the bottom terminus of the pipe string 26 and device 10.

Figure 2:
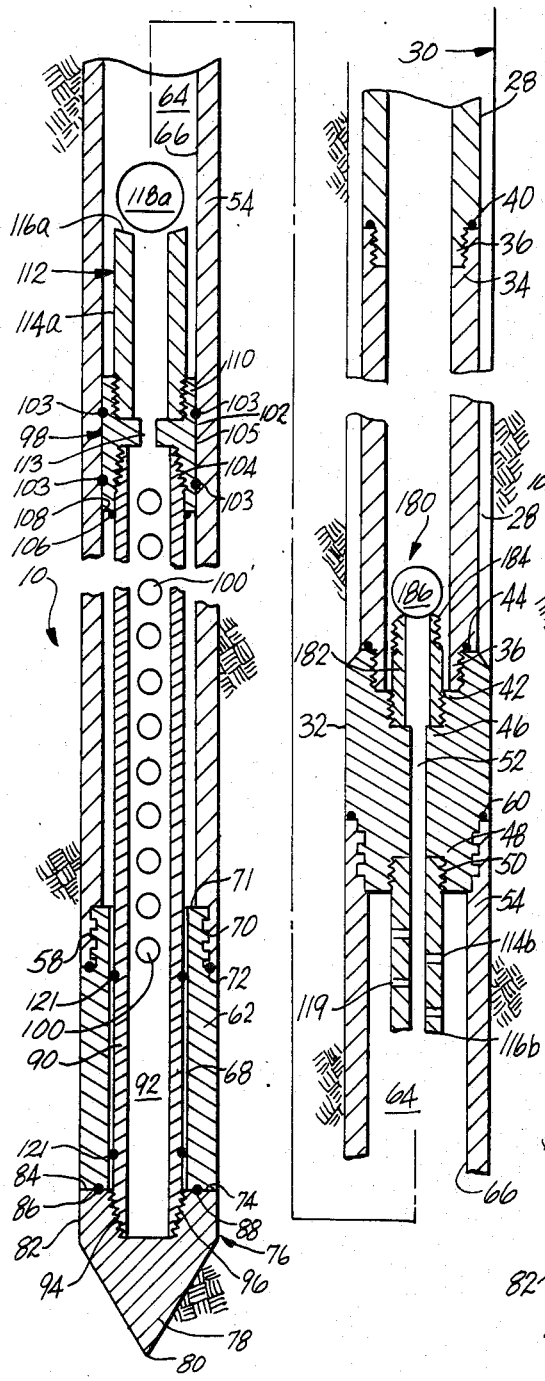
FIG. 2 is a side section view of one embodiment of a device provided in accordance with the present invention in a first condition for insertion into the ground.
Figure 3:
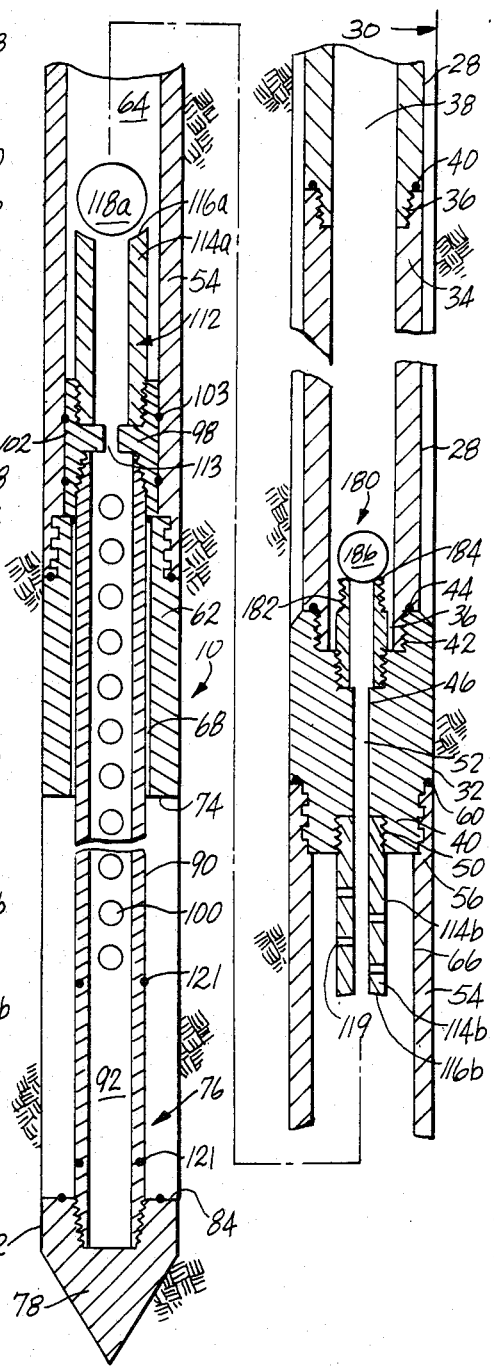
FIG. 3 is a side section view of the device of FIG. 2 shown in the second condition for gathering a ground water sample.

Turning to FIGS. 2 and 3, a preferred embodiment of the device according to the present invention is shown. FIG. 2 represents the device 10 in a condition for being inserted and during its insertion into the earth whereas FIG. 3 represents the device 10 in a condition to accept a ground water sample.

To attach the device 10 to the pipe segment 28 representing the bottom of the pipe string 26 an adaptor 32 is provided. As is commonly used, each pipe segment 28 is a section pipe having at one end an axially arranged, internally threaded conical bore defining a box end 34 for the segment 28. Opposite the box end 34 each segment includes an axially arranged, conical externally threaded pin end 36. The box ends 34 and pin ends 36 adapted to be threadably mated to join one segment to the other. When assembled, the segments 28 define an axial hollow passage 38 extending cooperatively through the segments 28 along the longitudinal length of the string 26. To seal the passage 38 at joined segments, an O-ring 40 may be provided between the segments box and pin end connections.

The adaptor 32 is cylindrical and may have a outer diameter somewhat greater than that of the pipe string segments 28. To join the device 10 to the segment 28 defining the lower terminus of the string 26, the adaptor 32 has at one end an axially arranged, threaded, conical bore defining a box 42 to threadably receive the pin end 36 of the segment 28. An O-ring 44 may be positioned between the adaptor 32 and segment 28 at the pin end and box connection to provide a liquid seal therebetween. The box 42 terminates at a threaded counter bore 46 the purposes of the which will hereinafter become evident.

Opposite the box 52 the adaptor 32 has an externally threaded end 48 to threadably couple the remaining components of the device 10 to the adaptor 32 and to the pipe string 26. An axial, threaded end bore 50 is provided at end 48 for purposes which will hereinafter become evident. An axial bore 52 through the adaptor 32 provides communication through the adaptor 32 with pipe string passage 38.

Coaxially secured to the adaptor end 48 the device 10 includes a main body 54 which may consist of a cylindrical length of pipe having an outside diameter comparable to or slightly less than that of the adaptor 32. Each end of the main body 54 includes a conical threaded bore defining, respectively, an upper box 56 which receives adaptor end 48 and a lower box 58. At the connection between the main body 54 and adaptor 32, an O-ring 60 is provided to maintain a liquid tight seal therebetween. The lower box, as described below, coaxially mounts a cone seal assembly 62. The main body 54, as stated above, may consist of a hollow length of pipe and defines between the adaptor 32 and cone seal assembly 62, a cylindrical sample receiving chamber 64 having a cylindrical wall 66. As described below, the chamber 64 receives and retains the ground water sample for retrieval from the bore 30 for utlimate analysis thereof. Accordingly, the main body 54 and wall 66 should be amenable to cleaning so that the device 10 may be reused without contaminants from previous testing being carried over into subsequent samples.

The cone seal assembly 62 is cylindrical having an outside diameter comparable to that of the main body 54 with an axial opening extending therethrough defining a guide bore 68. At one end, the assembly 62 is externally threaded defining a male end 70 adapted to be threadably coupled into the lower box 58 of the main body 54. The annulus defined at the male end 70 by the guide bore 68 fashions a stop 71 the purposes of which will hereinafter become evident. To seal the connection between the cone seal assembly 62 and main body 52 an O-ring 72 may be disposed therebetween. Opposite the male end 70, the cone seal assembly 62 terminates at an annular face 74 arranged transversely to the axis for the cone seal assembly 62 and main body 54.

To provide for the penetration of the earth by the device 10 and the drill string 26, the device 10 includes a subassembly 76 including a drive cone 78 adapted for penetrating the earth as the string 26 is inserted. Drive cone 78 has a height dimension which is coincident with the axis for the device 10 and a base diameter the same as or slightly smaller than that for the cone seal assembly 62, main body 54 and adaptor 32. Drive cone 78 has at one end a point 80 for penetrating the ground and at the other end, as defined by the base diameter, a cylindrical neck 82. Neck 82 defines at the end of the drive cone 78 opposite the point 80, a flat face 84 arranged transversely to the axis for the device 10 and adapted to be abuttingly engaged by the face 74 of the cone seal subassembly when the device 10 is in the condition for penetrating the earth as shown in FIG. 2. To provide a water tight seal between the cone 78 and cone seal assembly 62 an O-ring 86 is disposed in an annular groove 88 provided at face 84.

To supply the ground water sample to the chamber 64, subassembly 76 also includes a sample tube 90 affixed to the cone 78 in the embodiment of the device 10, according to FIGS. 2 and 3. The tube 90 has an outside diameter to closely pass through guide bore 68 in the cone seal assembly 62 and has inside diameter defining a passageway 92 along the length of the tube 90. Tube 90 has at one end an externally threaded head 94 for threadably coupling one end of the tube 90 to the cone 78. To accommodate the head 94 the cone includes an axial, threaded blind bore 96 penetrating the face 84 and spaced within the groove 88. Opposite the head 94 the tube 90 is threadably coupled to a slide 98 disposed within the main body chamber 64. To admit ground water into the passageway 92 for delivery to the chamber 64, the tube 90 includes a plurality of apertures 100 shown in the drawings as circular bores. It is to be understood that the apertures 100 may take any suitable shape and could, for example, be radial or circumferential slots to pass water from the ground into the passageway 92 for delivery to the chamber 64.

The slide 98 provides sliding support for the end of the tube 90 opposite the cone 78. Accordingly, slide 98 has an outer surface 102 with a diameter to be closely received within the chamber 64 and slide axially therein guided by the wall 66. Spaced O-rings 103 are disposed about the surface 102 to provide a sliding seal between the slide 98 and wall 66. The slide 98 has a threaded bore 104 at one axial end for coupling the tube 90 thereto. An O-ring 106 may be provided between the tube 90 and slide 98 to maintain a water tight seal therebetween. The annulus between the outer surface 102 and threaded bore 104 defines an annular shoulder 108 which abuts annular stop 71 of the cone seal assembly 62 to limit the movement of the main body 54 relative to the cone subassembly 76. At the opposite end the slide 98 has a threaded bore 110 adapted to mount a check valve assembly 112. An axial opening through the slide 98 between threaded bores 104 and 110 provides an opening 113 for communication between the tube 90 and the check valve assembly 112.

After the sample has been provided into the chamber 64 through the tube 90 as described below, it is necessary to prevent the sample from flowing in a reverese direction as the device 10 is withdrawn from the earth. Accordingly, the check valve assembly 112 is provided. While any suitable check valve assembly may be used a ball-type check valve assembly will be described for purposes of illustration. Check valve assembly 112 includes a sleeve **114*a* having one end threaded to mount the sleeve 114*a* to the slide 98. At the end opposite the slide 98, the sleeve 114*a* has fashioned thereon a spherical seat 116a adapted to receive and seat a ball 118*a*. As can be appreciated, when there is flow through the opening 113 and sleeve 114*a* in a first direction (upwardly in FIGS. 2 and 3) the flow urges the ball 118*a* from the seat 116*a* and accordingly fluid may pass freely through the check valve assembly 112. As the liquid fills the chamber 64 the ball 118*a* moves upwardly until it engages a sleeve 114*b* which has one end threaded into end bore 50 and has at the other end a seat 116*b* to seat the ring ball 118*a*. After the ball 118*a* has seated, the admitted fluid passes through several bores 119 provided in sleeve 114*b* through axial bore 52 and into the passage 38. Should a head differential occur tending to urge fluid flow in a reverse direction through the sleeve 114*a*, the ball 118*a* will seat and seal against the sleeve seat 116*a*** preventing this reverse flow and discharge of the collected sample.

To confine the ground water sample received into the passage 38 and prevent it from flowing downwardly through the chamber 64, a second check valve assembly 180 is provided at the adaptor counter bore 46. The second check valve assembly 180 includes a sleeve 182 threadably connected at one end into the adaptor counter bore 46 and having at the other end a seat 184. A ball 186 within the passage 38 is adapted to seat with seat 184 and prevent the sample from flowing downwardly through the adaptor bore 52 and into the chamber 64. Incidentally, the seating of the ball 186 on seat 184 tends to prevent the contents of chamber 64 from emptying since, by closing the bore 52 there is no effective vent. As may occur, the hydrostatic pressure of the ground water source could tend to urge the sample to flow upwardly through the adaptor 32 and into the pipe string 26. By providing the second check valve assembly 180 ground water which has contacted the pipe stem 26 is prevented from re-entering the chamber 64.

To obtain a sample of ground water the device 10 as described above is inserted into the earth to the desired depth in the condition shown in FIG.2. In that the cone neck 82 has a diameter the same or somewhat smaller than that of the remaining components, the bore 30 in the earth defined by the device conforms to the adapter 32; and main body 54. It is to be understood that the cone and main body could be configured so that the device gradually tapers outwardly from the cone to meet the adapter 32. Once the device 10 has been inserted to the proper depth, the pipe string 26, main body 54, and connected cone seal assembly 62 are withdrawn relative to the cone subassembly 76 to a position as shown in FIG. 3 representing a sample receiving condition for the device 10. The guide bore 68 guides the relative movement between the cone seal assembly 62 along the tube 90, the tube 90 being supported at one end by the cone 78 and at the other end by the slide 98 which slides downwardly within the chamber 64 to support the tube 90. Accordingly, the slide 98, tube 90 and guide bore 68 co-act to slidably guide and support the relative movement between the components. O-rings 121 ar provided between the tube 90 and cone seal assembly 62 to provide a liquid tight, slidable seal therebetween. When the main body 54 has been withdrawn to a position where the slide shoulder 108 contacts the stop 71 of the cone seal assembly 62, the movement relative to the cone subassembly 76 is halted.

The relative movement between the components results in the tube apertures 100 becoming exposed to the ground water. The ground water, by virtue of the hydrostatic pressure at the outside of the device at atmospheric pressure within the chamber 64 flows through the apertures 100 into the passageway 92 up the tube 90 through the slide opening 113 and first check valve assembly 112 into the sample chamber 64. When the chamber 64 has filled, the fluid may tend to flow into the passage 38 through the second check valve assembly 180. After a period of time necessary to collect a sample has passed, the device 10 is retrieved from the bore 30 by pulling the pipe string 26 upwardly and sequentially disassembling the segments 28. While the device is moving upwardly, the slide 98 maintains contact with the cone seal assembly 62 in the position as shown in FIG. 3. To prevent the sample in the chamber 64 from discharging back through the extended tube 90, the first check valve assembly 112 closes and seals.

To transfer the sample from the chamber 64 to a container or vial (not shown) the last segment 28 is uncoupled from the adaptor box end 34 and a transfer tube or the like is threadably coupled to sleeve 182. The device 10 is somewhat inverted to permit the sample through the adaptor 32 and into a container. The ball 186 of the second check valve assembly 180 is removed prior to the sample transfer to the container.

Figure 4:
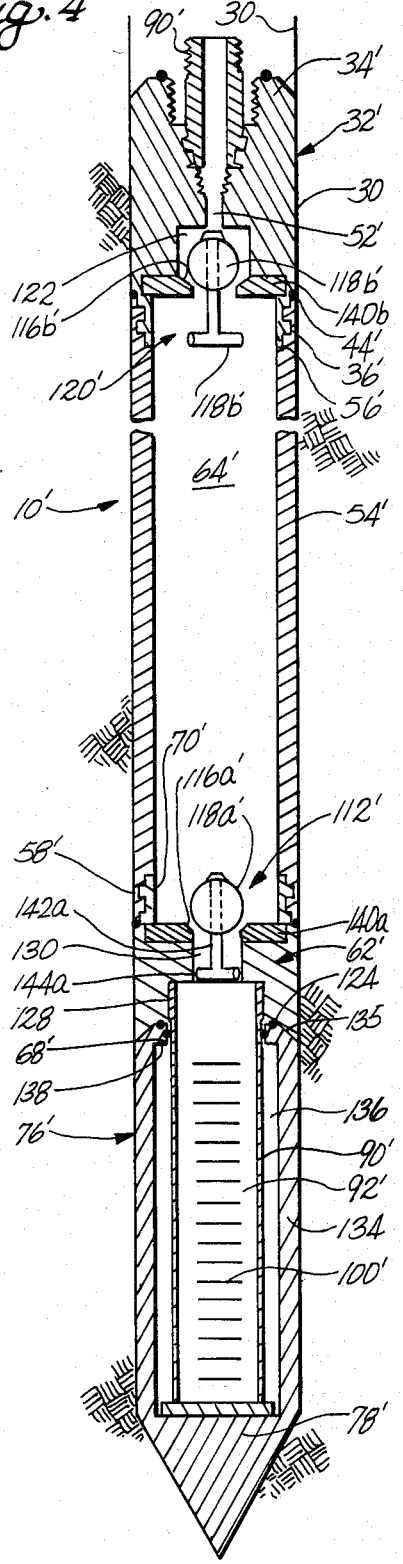
FIG. 4 is a side section view of another embodiment of a device provided in accordance with the present invention shown in a first condition for insertion into the ground.
Figure 5:
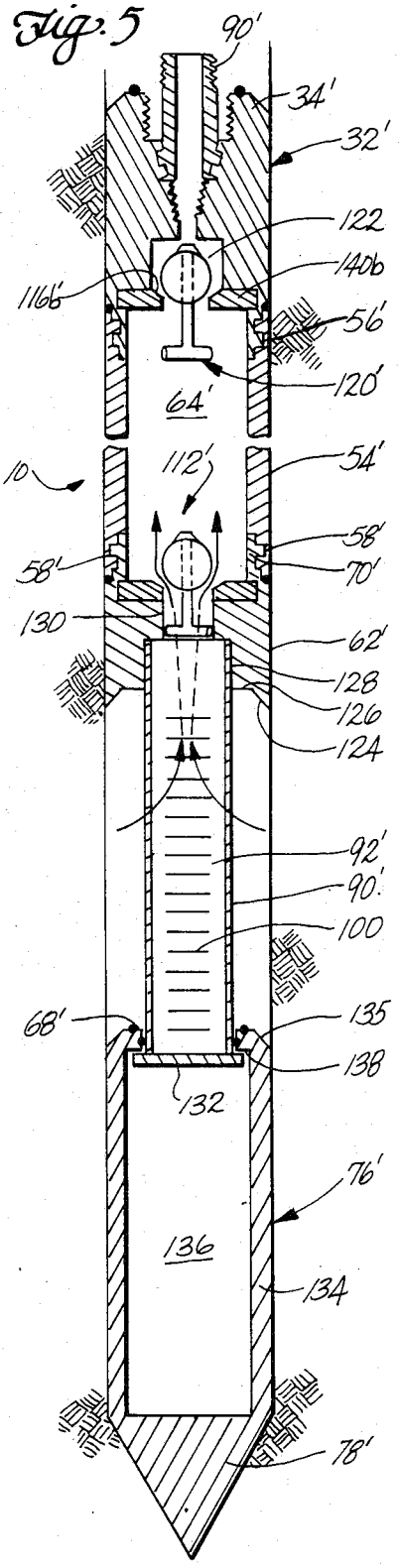
FIG. 5 is a side section view of the device of FIG. 4 shown in a second condition for gathering of a ground water sample.

Turning to FIGS. 4 and 5, a second preferred embodiment of the device according to the present invention is shown. Parts similar to those identified with reference to FIGS. 2 and 3 will carry the same reference numerals with a prime (') designation.

The device 10' according to this embodiment includes an adaptor 32' having at one end a box end 34' for coupling to the adjacent pipe segment 28 and at the other end a pin end 36. O-ring 44' is disposed at the box end connection to the pipe segment 28. Threaded counter bore 46' is disposed axially opening into the box end 34' that one end and at the other end intersecting opening 52'. At the pin end 36' an axial receptacle 122 is provided for purposes which will hereinafter become evident.

Connected to the adaptor 32', the device 10' includes main body 54' which is cylindrical having an outer diameter equal to or less than that of the adaptor 32' and is hollow defining a sample receiving chamber 64'. At one end the chamber 64' terminates at the adaptor 32' and at the other end at a coaxially disposed cone seal assembly 62'. To couple the main body 54' to the adaptor 32', the main body has upper and lower boxes 56' and 58'. Upper box 56' threadably receives the pin end 36' of the adaptor 32' whereas lower box 58' threadably couples the cone seal assembly 62' to the main body 54'.

Cone seal assembly 62' is cylindrical having an outer diameter the same as the main body 54' and having at one end a threaded male end 70' which is threadably received by the lower box 58'. Opposite the male end 70', the cone seal assembly 62' has an inwardly tapered, conical face 124 the purposes of which will be hereinafter become evident. Face 124 termninates at a bottom end 126 which is annular surrounding a first bore 128. First bore 128 is arranged axially penetrating the assembly one end and terminating at a lesser diameter second bore 130.

Secured at one end within the first bore 128 is the sample collection tube 90' which has at its other end a flange 132. The tube 90' is hollow having a plurality of apertures 100' shown as being circumferential slots but which may also be holes or the like. Tube 90' defines a hollow passageway 92' which communicates through the second bore 130 with the sample chamber 64'.

To house, conceal and protect the tube 90' during the insertion of the device 10' into the ground, a coaxially disposed drive cone subassembly 76' is proivded. Drive cone subassembly 76' includes a drive cone 78' the height dimension of which is coincident with the axis for the device 10' and the base diameter is the same as or less than the main body 54' and cone seal assembly 62'. Projecting axially from the cone 78', the subassembly 76' further includes a cylindrical casing 134 having a diameter equal to that of the main body 54', the casing terminating opposite the cone 78' at a face 135 configured to mate with the face 124 of the cone seal assembly 62'. Casing 134 defines a cylindrical hollow cavity 136 which extends from within the drive cone 78' to a location proximate the face 135'. A lesser diameter guide bore 68' extends axially through the face 135 into the cavity 136, the guide bore 68' having a diameter to closely pass the tube 90'. Between the bounds of the casing 134 and guide bore 68' an annular stop 138 for the cone subassembly is defined. To seal against the tube an O-ring may be provided at the guide bore 68'.

As shown in FIG. 4, the device 10' is in condition to be inserted into the ground to the desired depth. The pipe string 26, adaptor 32', main body 54' and cone seal assembly 62' are driven downwardly the cone seal assembly 62' abutting the cone subassembly 76' with the cone 78' providing the point to penetrate the ground. When the desired depth is reached at which the ground water sample is to be obtained, the main body 54' and cone seal assembly 62' are withdrawn relative to the cone subassembly by withdrawing the pipe string 26. The cone subassembly 76' is held in place by the friction between the bore 30 and cone 78'. The withdrawal of the main body 54' and cone seal assembly 62' pulls the tube 90' from the casing 134 exposing the apertures 100 to the ground water. Guide bore 68' guides the withdrawal of the tube 90 from its enclosing casing 134 and slidably supports the relative sliding motion between the components. Withdrawal is terminated when the tube flange 132 contacts the stop 138.

Ground water enters the tube 90' through the apertures 100' and by virtue of hydrostatic pressure flows upwardly through the tube and second bore 130 of the cone seal assembly 62' into the chamber 64'. To prevent the sample provided into the chamber 64' from flowing in a reverse direction, a first check valve assembly 112' is disposed at the second bore 130. The first check valve assembly 112' includes a ring 140*a*' disposed between the main body lwoer box 58' and cone seal assembly male end 70'. An annular spherical seat 116*a*' is provided at the ring for seating a ball 118*a*'. A retainer 142*a* is connected through the ball 118*a*', the retainer 142*a* having a foot 144*a* disposed within the second bore 130 of a size greater than the opening defined by ring 140. Accordingly, the ball 118*a*' is retained relative to the ring 140.

The ground water flowing upwardly through the tube 90' passes through the second bore 130 and first check valve assembly 112' urging the ball 118*a*' upwardly as the liquid fills the chamber 64'. The fluid, depending upon the hydrostatic pressure, may fill the chamber 64' and urge a second check valve assembly 120' disposed at the opposite end of the chamber 64 opens to admit the fluid into the pipe string passage 38. The second check valve assembly 120' is similar to the first check valve assembly 112' and is similarly mounted including a ring 140 connected between the adaptor 32' and main body 54', the ring 140 having a seat 116*b*. A ball 118*b*' is provided and is retained at the ring 140*b* by a retainer 142*b*. As the chamber 64' is being filled, the second check valve assembly 120' is opened, its ball 118*b*' is displaced upwardly relative to the seat 116*b*' into receptacle 122. The fluid can, accordingly, pass through the adaptor 32' and into the pipe string 26.

After the sample has been provided to the chamber 64, the device 10' is pulled from the bore 30 by ram 14 and the segments 28 are sequentially disassembled. The first check valve assembly 112' prevents the collected sample from being inadvertently discharged from the chamber 64 as the device 10' is being retrieved. The second check valve assembly 120' prevents ground water contained in the pipe string 26 from flowing back into chamber 64'. After the device 10' has been removed completely from the bore 30, the sample in the chamber is removed to a suitable container through the tube 90'.

It may, under some circumstances, be desirable to use the device as a permanent monitor well or for pieziometric mapping or any other instance where it is desired to have the water fluctuate in the pipe string. According to this embodiment, the first and second check valve assemblies would be rendered inactive permitting the ground water to enter the pipe string whereupon it may flow upwardly or downwardly due to change in hydrostatic pressure or may be lifted to the surface by any suitable means.

As can be appreciated, the device according to the present invention, provides an inexpensive method and mechanism for retrieval of a chemically representative ground water sample. The sample colelcting means are safely housed and sealed within the device as it is being inserted into the ground. Hence, inadvertent samplings at lesser depths are not obtained during insertion of the device which would adversely affect the accuracy of the sampling. Further, elaborate mechanisms such as wires, cables or lines are not required since the device is operated from the first condition to the sample collecting condition by merely incrementally pulling on the pipe string.

While I have shown and described certain embodiments of the present invention, it is subject to many modifications without departing from the spirit and scope of the claims set forth therein.

What is claimed is:

1. A device adapted to be inserted into the ground to obtain a ground water sample and configured to be withdrawn intact from the ground so that the ground water sample may be collected therefrom, the device comprising:

a drive cone subassembly adapted to penetrate the ground;

a body having a closed sample chamber, the body movable relative to the drive cone subassembly between a first position where the body and drive cone subassembly abut for inserting the device into the ground and a second position where the drive cone subassembly is frictionally restrained by the ground and the body is withdrawn upwardly relative to the drive cone subassembly;

a sampling tube affixed to one of said drive cone subassembly or body, the sampling tube including a plurality of apertures to receive ground water and communicating with the sample chamber, the sampling tube isolated from the ground water when the body is at the first position, withdrawal of the body to the second position exposing the sampling tube openings to deliver a ground water sample to the sample chamber; and means for preventing the sample from reversely passing from the sample chamber through the sampling tube as the device is being withdrawn from the ground.

2. The device of claim 1 wherein the sampling tube is attached at one end to the drive cone subassembly, the other end of the sampling tube disposed in the sample chamber.

3. The device of claim 2 further including means for slidably supporting the sampling tube other end in the chamber.

4. The device of claim 3 wherein the supporting means includes a slide affixed to the sampling tube other end and slidably disposed within the sample chamber.

5. The device of claim 1 wherein the sampling tube has one end affixed to the body and extends into a cavity in the drive cone subassembly when the body is at the first position.

6. The device of claim 1 wherein the preventing means includes a check valve assembly disposed at the connection between the sampling tube and sample chamber to prevent reverse flow of the sample from the sample chamber.

7. A device adapted to be inserted into the ground at the end of a pipe string to obtain a ground water sample and configured to be withdrawn from the ground intact so that the ground water sample may be collected therefrom, the device comprising:

a cone subassembly adapted to penetrate the ground to the desired depth;

a body including a chamber and connected to one end to the pipe string, the pipe string and body movable upwardly relative to the cone subassembly from a first condition where the body engages the cone subassembly for insertion of the device and string into the ground to a second condition where the body is spaced from the cone subassembly;

a sampling tube communicating with the chamber and concealed by the body and cone subassembly when the body is in the first condition, relative movement of the body to the second condition exposing the tube to receive ground water and deliver it to the chamber; and means for preventing the sample from reversely passing from the sample chamber through the sampling tube as the device is being withdrawn from the ground.

8. The device of cliam 7 wherein the sampling tube is attached at one end to the cone subassembly, the other end communicating with the chamber, the device further including means for slidably guiding the relative movement of the body relative to the cone subassembly.

9. The device of claim 8 wherein the sampling tube other end is disposed axially within the chamber, the guiding means including a slide attached to the tube other end, the chamber sildably supporting the slide and tube other end.

10. The device of claim 7 wherein the sampling tube is affixed at one end of the body and the cone subassembly includes a casing with a cavity to conceal the tube when the body is in the first condition, the tube adapted to withdraw from the cavity when the body is moved to the second condition.

11. The device of claim 7 wherein the reverse sample flow preventing means includes a check valve assembly disposed at the connection between the sampling tube and the sample chamber to thereby prevent such reverse flow of the sample from the sample chamber.

12. The device of claim 7 wherein the sample chamber communicates with the interior of the pipe string, and wherein means are provided for preventing ground water which has passed through the sampling tube, through the sample chamber and into the pipe string, from reversely passing from the pipe string back into the sample chamber.

13. The device of claim 12 wherein the means for preventing flow of ground water from the pipe string back into the sample chamber includes a check valve assembly disposed at the location of the connection between the sample chamber and pipe string.

14. A device adapted to be inserted into the ground at the end of a pipe string to obtain a ground water sample, the device comprising:

a main body having one end connected to the pipe string and defining a hollow chamber to receive said sample and;

a cone seal assembly coaxially affixed to an other end, the cone seal assembly having an axial guide bore;

a cone subassembly adapted for penetrating the ground, the cone seal assembly abutting the cone subassembly as the device is inserted into the ground at the end of the pipe string, said pipe string, main body and its cone seal assembly movable upwardly relative to the cone subassembly to a sample position to provide said sample to the device;

a tube connected at one end to the cone subassembly and at the other end slidably guided within the chamber by guide means, the tube being concealed within the chmber and cone seal assembly guide bore during insertion of the device into the ground and being exposed when the pipe string, main body, and its cone seal assembly are at the sample position, the tube including apertures to admit ground water into the chamber; and a check valve disposed at the tube other end to prevent discharge of the sample from the chamber through the tube.

15. A device adapted to be inserted into the ground at the end of a pipe string to obtain a ground water sample, the device comprising:

a main body having one end connected to the pipe string and defining a hollow chamber to receive said sample and;

a cone seal assembly coaxially affixed to an other end;

a cone subassembly having a cone adapted to penetrate the earth and a coaxial casing having a cavity, the cone subassembly abutting the cone seal assembly for insertion of the device into the ground;

a tube communicating with the chamber and having one end affixed to the cone seal assembly and a plurality of apertures to admit ground water into said chamber, the tube received into the cavity, wherein the pipe string, main body and cone seal assembly are movable upwardly relative to the cone subassembly to withdraw the tube from the cavity to admit ground water into the chamber; and a check valve disposed at the tube one end to prevent discharge of the sample from the chamber through the sample tube.

16. A method for obtaining a ground water sample comprising:

inserting a device into the ground, the device including, a main body having a chamber, a cone subassembly adapted to break ground, the cone arranged to abut the main body, and a tube communicating with the chamber and having apertures to receive ground water, the tube connected at one end to the cone subassembly, the tube concealed witin the main body during the inserting step;

withdrawing the main body relative to the cone subassembly to a position where the tube is exposed to provide a ground water sample to the chamber; and retrieving the device from the ground while closing the tube to prevent the sample from discharging from the chamber through the tube during the retrieval of the device.

17. A method for obtaining a ground water sample comprising:

inserting a device into the ground, the device including, a main body having a chamber, a cone subassembly adapted to break ground, the cone assembly arranged to abut the main body, and a tube communicating with the chamber and having apertures to receive ground water, the tube connected at one end to the body, the tube concealed within the cone subassembly during the inserting step;

withdrawing the main body and connected tube relative to the cone subassembly to a position where the tube is exposed to provide a ground water sample to the chamber; and retrieving the device from the ground while closing the tube to prevent the sample from discharging from the chamber through the tube during the retrieval of the device.

* * * * *

UNITED STATES PATENT AND TRADEMARK OFFICE

CERTIFICATE OF CORRECTION

PATENT NO. : 4,669,554

DATED : June 2, 1987

INVENTOR(S) : Kent E. Cordry

It is certified that error appears in the above-identified patent and that said Letters Patent is hereby corrected as shown below:

Column 3, line 57, "52" should read -- 42 --; column 6, line 25, "ar" should read -- are --; column 7, line 36, "proivded" should read -- provided --; column 8, line 14, "lwoer" should read -- lower --; column 8, line 64, "colelcting" should read -- collecting --; column 9, line 65, delete "to" and insert -- at --; column 10, line 14, "cliam" should read -- claim --; column 10, line 22, "sildably" should read -- slidably --; column 10, line 25, after "end" delete "of" and insert -- to --; column 10, line 66, "chmber" should read -- chamber --; column 12, line 6, "witin" should read -- within --.

Signed and Sealed this

Second Day of August, 1988

*Attest:*

DONALD J. QUIGG

*Attesting Officer*

*Commissioner of Patents and Trademarks*